US006875094B2

(12) United States Patent
Caporusso

(10) Patent No.: US 6,875,094 B2
(45) Date of Patent: Apr. 5, 2005

(54) WORKTABLE FOR AN APPARATUS FOR GRINDING RECESSES

(75) Inventor: Alessandro Caporusso, Piedimonte San Germano (IT)

(73) Assignee: New Tech S.r.l., Piedimonte San Germano (IT)

( * ) Notice: Subject to any disclaimer, the term of this patent is extended or adjusted under 35 U.S.C. 154(b) by 57 days.

(21) Appl. No.: 10/238,722

(22) Filed: Sep. 11, 2002

(65) Prior Publication Data

US 2003/0083004 A1 May 1, 2003

(30) Foreign Application Priority Data

Sep. 12, 2001 (IT) ..... RM2001A0553

(51) Int. Cl.[7] ..... B24B 21/12; B24B 21/20
(52) U.S. Cl. ..... 451/296; 451/299
(58) Field of Search ..... 451/296, 311, 451/303, 305, 299, 355, 51, 489, 365, 387, 393

(56) References Cited

U.S. PATENT DOCUMENTS

| | | | | | |
|---|---|---|---|---|---|
| 2,113,387 | A | * | 4/1938 | Silven | 451/252 |
| 2,136,188 | A | * | 11/1938 | Gagne et al. | 451/218 |
| 2,606,767 | A | * | 8/1952 | Preston | 279/4.04 |
| 2,802,310 | A | * | 8/1957 | Rubin | 451/296 |
| 3,163,085 | A | | 12/1964 | Wishing | |
| 4,712,954 | A | | 12/1987 | Campolito | |
| 4,987,701 | A | * | 1/1991 | Humbert | 451/307 |
| 5,357,714 | A | * | 10/1994 | Landhuis | 451/311 |
| 6,186,024 | B1 | | 2/2001 | Leiber | |

* cited by examiner

*Primary Examiner*—Robert A. Rose
(74) *Attorney, Agent, or Firm*—Young & Thompson

(57) ABSTRACT

A worktable for an apparatus for grinding recesses, having on a frame (3) a pair of pulleys carrying a grinding belt (2), is provided with a sole control member (19) to approach and move apart said workpiece vice (20) with respect to said shaping pulley (1) of said pair of pulleys.

6 Claims, 8 Drawing Sheets

WORKTABLE FOR AN APPARATUS FOR GRINDING RECESSES

BACKGROUND OF THE INVENTION

The present invention relates to a worktable for an apparatus for grinding recesses.

The apparatus for grinding recesses, which reference is made to in the following description, is a hand operated machine, also called notching machine, that is adapted for recessing, by grinding, in ends of tubular workpieces. This apparatus has a pair of pulleys carrying a grinding belt: one of the pulleys is a driving pulley for the grinding belt, and the other pulley is a shaping pulley co-operating with the grinding belt to shape recesses. A vice for clamping a pipe to be worked is located near the shaping pulley and is movable according to a movement towards and away from the shaping pulley, to allow a pipe, that is clamped by the vice, to be ground.

In order to achieve such a movement in prior art apparatuses for grinding recesses, the vice for clamping pipe is mounted rotatable on a worktable in such a position with respect to the shaping pulley that the axis of the shaping pulley and the axis of the pipe to be worked form a desired angle in a generally horizontal plane that is defined by the same axes. Usually, said angle can be changed between 90 and 30 degrees. The worktable, that is generally constituted by a pair of slides sliding on mutually orthogonal axes, has a feeding movement with respect to the shaping pulley that is obtained through two orthogonal movements and is controlled by generally manual feed means along such orthogonal axes, one of which is parallel to the axis of the shaping pulley.

These feed means comprise prismatic guides, that are usually made by a pair of parallel cylindrical sections co-operating with correspondent through holes that are made in the slides of the worktable, and parts in mutually orthogonal movement are each operated by wheels, worm screws or rack-and-pinion gears, or other, that are controlled through handwheels or lever-operated links.

In any case, the operation along one direction of the one slide in the worktable is independent of the operation of the other slide in the other direction, at right angles to the first direction. Therefore, it happens that an operator performs a recess in a tubolar workpiece by simply approaching the tubolar workpiece to the grinding belt, usually in a central position thereof widthwise. Of course, the grinding belt will be worn unevenly and its life will be reduced consequently.

Now, an operator careful to prolong the life of a grinding belt must act cunningly so that the grinding of a recess is performed throughout the width of the belt, while the belt runs endless on the two pulleys of the apparatus. This should require a great diligence of the operator.

The present invention aims at overcoming the above mentioned drawbacks.

SUMMARY OF THE INVENTION

In particular, an object of the present invention is to permit each workpiece to be worked automatically throughout the width of a grinding belt so that the wear of all its surface is uniform, which can prolong the life of the grinding belt.

Another object of the invention is to reduce the labour of an operator at the grinding apparatus, the operator having to act on a sole control means to perform a notching.

This object is achieved by the present invention through a worktable for an apparatus for grinding recesses having on a frame a pair of pulleys carrying a grinding belt moving endless along a lengthwise axis of said frame, the worktable supporting a workpiece vice that is pivoted around an orthogonal pivoting axis on its first slide and can be set in its angular position with respect to a shaping pulley of said pair of pulleys, characterized in that the worktable is provided with a sole control member to approach and move apart said workpiece vice with respect to said shaping pulley.

As a result of the sole operating control, a recess is ground in a tubolar workpiece end using the entire width of the grinding belt. The distribution of the heat produced when the workpiece is worked is extended to all the surface of the grinding belt, and this feature, together with the uniform use of the grinding belt, brings about an increase of its life.

Advantageously, such a working performed on the end of a tubolar workpiece, by virtue of the combined movement of lengthwise feeding toward the grinding belt and transversal traverse with respect to the same grinding belt, permits a high finishing degree to be obtained on the workpiece, as the burr produced during the working is greatly reduced, also for the better distribution of the heat on the grinding belt than before.

BRIEF DESCRIPTION OF THE DRAWINGS

The invention will be described below with reference to two embodiments thereof with connection to the enclosed drawings, in which.

DESCRIPTION OF THE PREFERRED EMBODIMENTS

Figure 1:
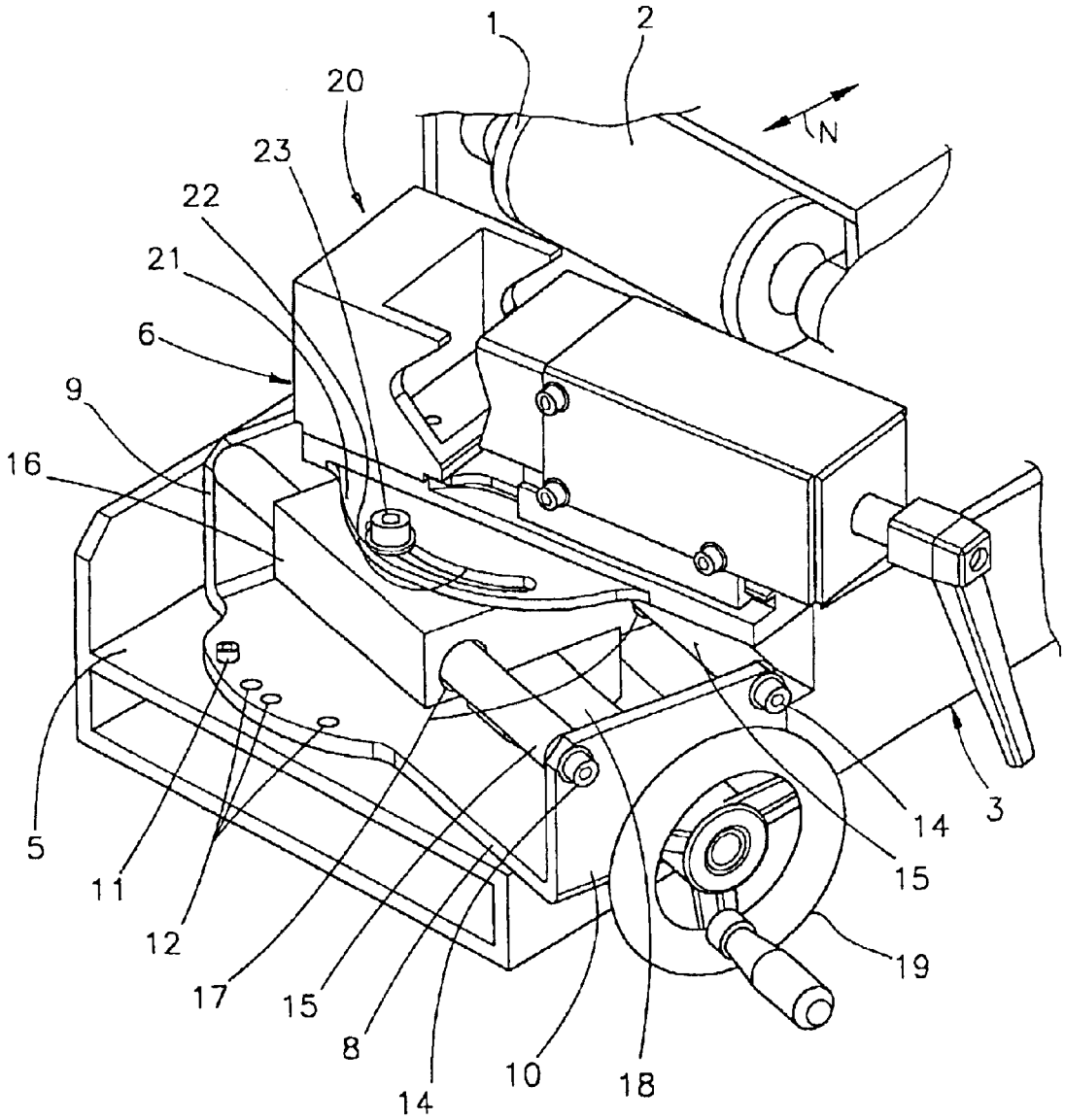
FIG. 1 is a perspective view of a first embodiment of a worktable according to the present invention as applied to an apparatus for grinding recesses that is shown only partially.
Figure 2:
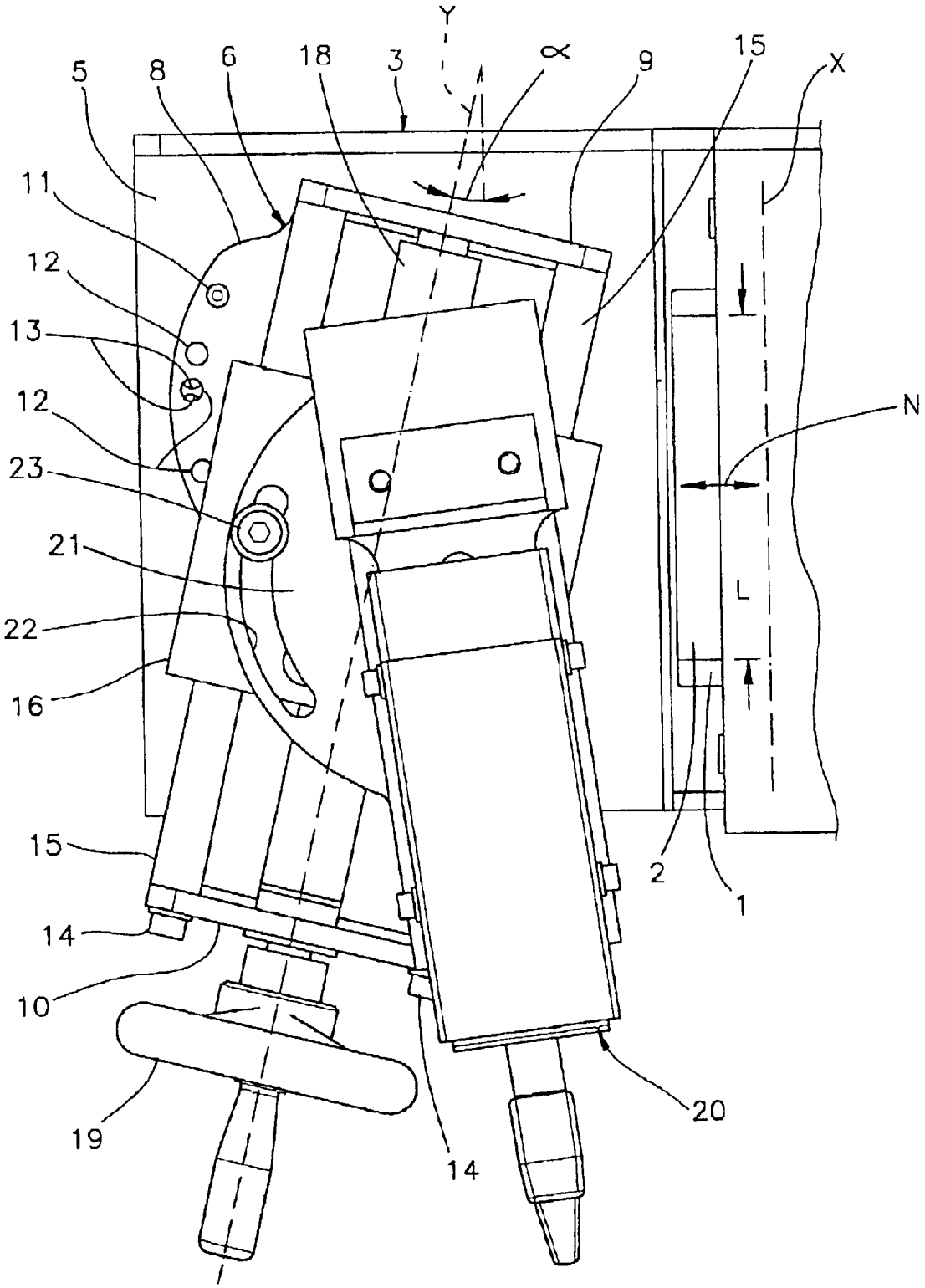
FIG. 2 is a top view of the first embodiment of a worktable as shown in FIG. 1.
Figure 3:
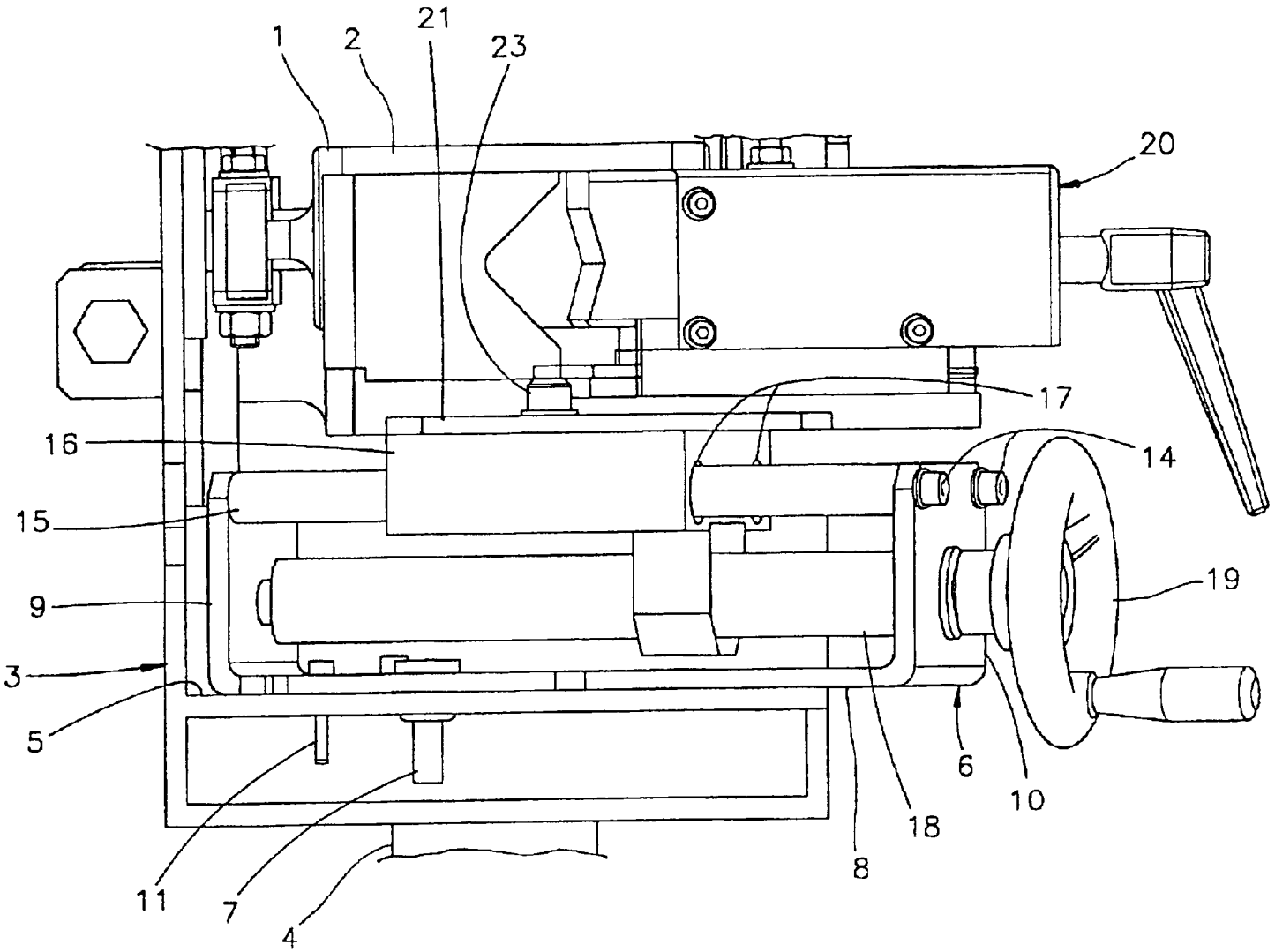
FIG. 3 is a front view of the first embodiment of a worktable as shown in FIG. 1.

First with reference to FIGS. 1 to 3, an apparatus for grinding recesses is shown therein only with respect to its shaping pulley 1 having an axis x and on which a grinding belt 2 runs, and to a portion of frame 3 thereof, which is supported by a pedestal 4 (FIG. 3). A worktable according to a first embodiment of the present invention, that is designed in general as 6, is sustained by a depressed portion 5 of the frame 3.

Pivoted to the depressed portion 5 of the frame 3 by means of a pin 7 is a platform 8, that is bent into a U shape in opposite vertical walls 9, 10. The platform 8, that is revolving around the pin 7, can be set in its angular position through its axis y at right angles to the vertical walls 9, 10 with respect to the lengthwise direction of movement of the grinding belt 2, that is indicated by the arrow N in FIG. 2, i.e. with respect to the axis x of the shaping pulley 1. The platform 8 can be set by introducing a check pin 11 into through holes, that are made in the revolving platform 8 and are designated generally as 12, and into through holes 13 that are made in the frame 3. The purpose of setting the platform 8 will be described below.

Two cylindrical sliding guides 15 for a slide 16 are connected to the vertical walls 9, 10 of the platform 8 by means of screws 14. As it is usual, the slide 16 has correspondent through holes 17 engaging the cylindrical guides 15. Also a shaft 18, provided with a handwheel 19, is disposed on the vertical walls 9, 10 of the platform 8. The handwheel 19 is the manual control member of movement of the slide 16 on the cylindrical guides 15. The connection between the shaft 18 and the slide 16 is not explained below, as it is conventional.

A vice 20 for a workpiece is mounted revolving on the slide 16. Conventionally, the workpiece vice 20 has a base 21, which is provided with a slot 22 in the form of a circle arch and a securing screw 23 adapt to be fixed to the slide 16, for setting the angular position of the workpiece vice 20 with respect to the direction N of movement of the grinding belt 2.

From foregoing one can understand that, differently from the prior art, the manual control is performed through a sole control member, i.e. the handwheel 19. The angle $\alpha$ is the angle between the axis y along which the slide 16 slides, at right angles to the walls 9, 10 of the platform 8, and the axis x of the shaping pulley 1 (FIG. 2). According to the present invention this angle $\alpha$ is selected on the grounds of the depth of the recess to be performed on the end of the tubolar workpiece, considering that, in order to obtain a uniform wear of the grinding belt 2, the grinding operation must be performed throughout the width L of the same grinding belt 2. Of course, the depth of the recess in turn depends on a diameter D of a tubolar workpiece (not shown) and on an inclination of the last one with respect to the grinding belt.

It should be understood easily that, for a recess throughout the entire diameter D of a tubolar workpiece, e.g. a recess having its axis that is at right angles to the axis of the tubolar workpiece, the size of the angle $\alpha$ must be selected so that the cathetus opposite to the angle $\alpha$ in a right-angle triangle, having as other cathetus the width L of the grinding belt 2, is of size D/2. Such an angle $\alpha$ must be set by means of the check pin 11 introduced concentrically into a hole 12 of the platform 8 and the suitable hole 13 of the frame 3.

In the above mentioned example of a recess having its axis at right angles to the axis of the tubolar workpiece, the workpiece vice 20 must be retained with such an inclination that the axis of the tubolar workpiece coincides with the direction of the arrow N of movement of the grinding belt 2, i. e. it is at right angles to the axis x of the shaping pulley 1. On the contrary, when one wants perform a recess having its axis inclined by a set angle to the axis of the tubolar workpiece, he must incline the workpiece vice 20 by the same set angle by means of the slot 22 and the securing screw 23.

Now, with reference to FIG. 4, in which same or similar numerals are used to designate the same parts or similar to those described with reference to FIGS. 1 to 3, an apparatus for grinding recesses is shown therein only with respect to its shaping pulley 1 having an axis x, shaping pulley on which a grinding belt 2 runs, and to a portion of frame 3 thereof. A worktable 60 according to a second embodiment of the present invention is sustained by a depressed portion 5 of the frame 3.

Figure 5:
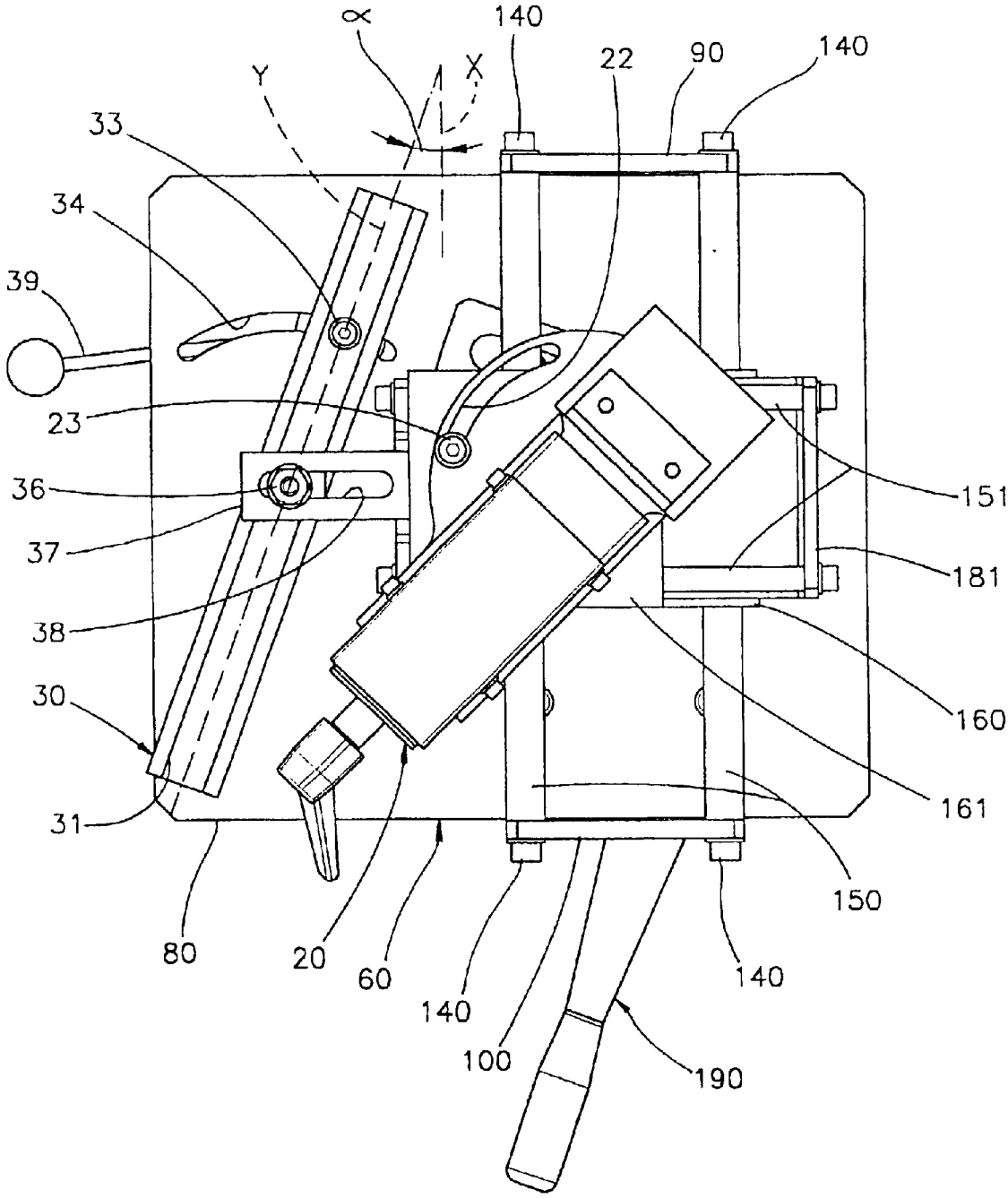
FIG. 5 is a top view of the second embodiment of a worktable.
Figure 6:
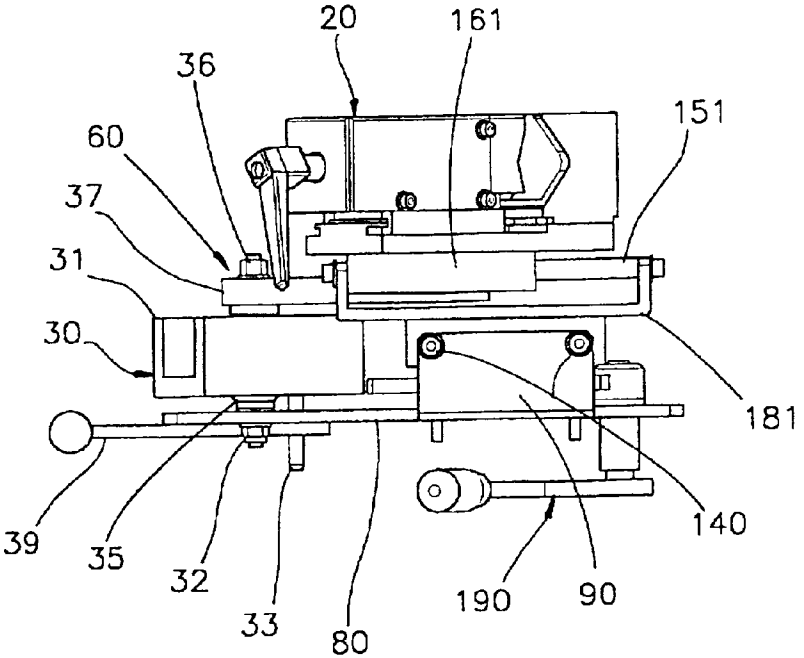
FIG. 6 is a front view in reduced scale of the second embodiment of a worktable as shown in FIG. 5.
Figure 7:
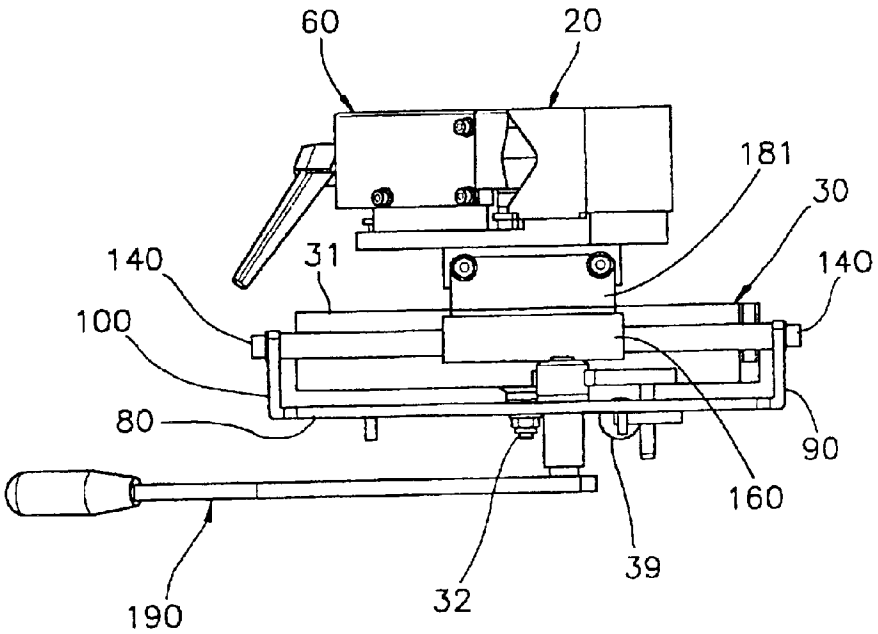
FIG. 7 is a right hand side view in reduced scale of the second embodiment of a worktable as shown in FIG. 5.

The worktable 60 is depicted, as detached from the apparatus in the FIGS. 5 to 7, that are a top view and vertical side views respectively, of the same.

Figure 4:
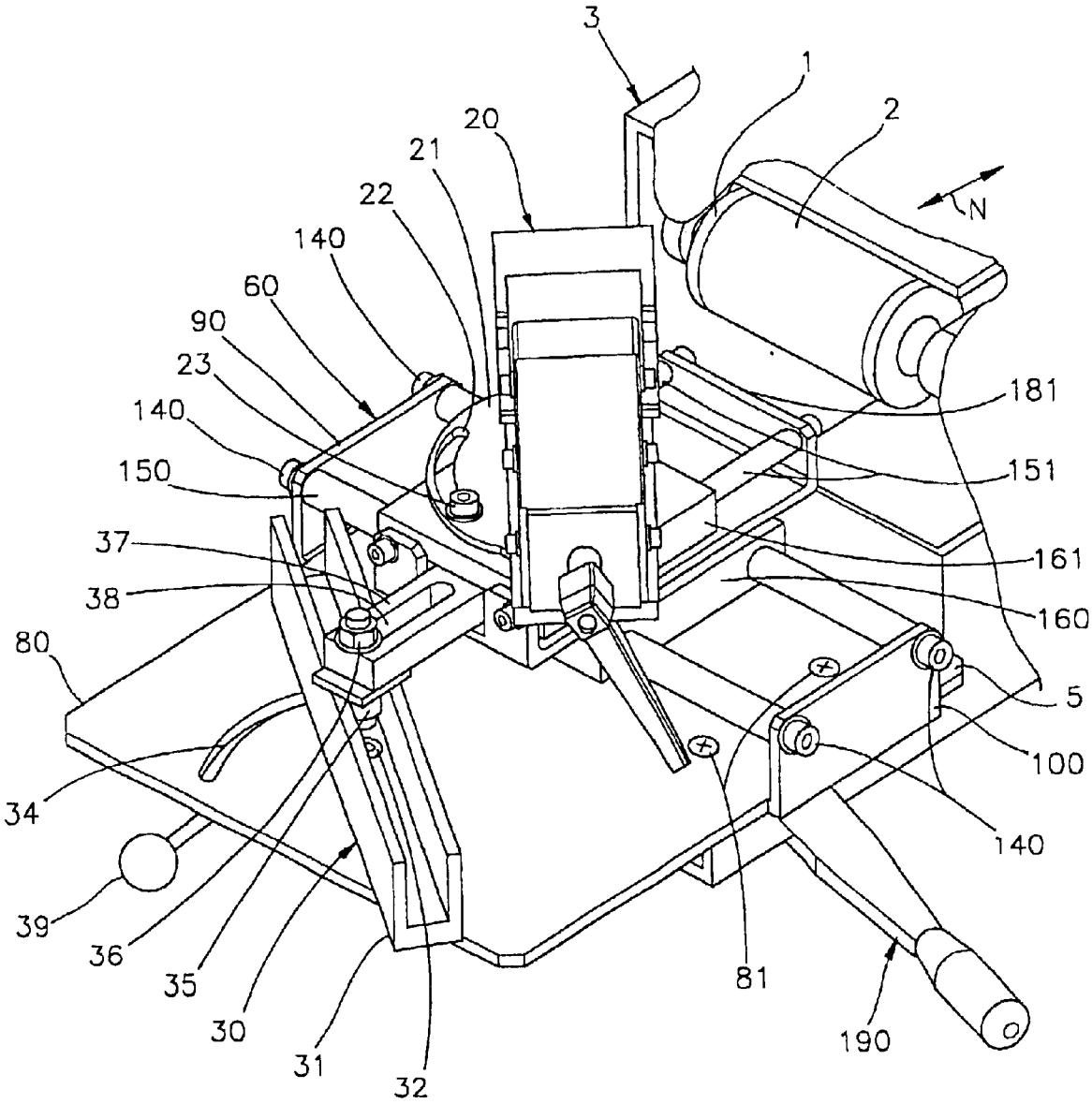
FIG. 4 is a perspective view of a second embodiment of a worktable according to the present invention as applied to an apparatus for grinding recesses that is shown only partially.

The worktable 60 comprises a platform 80 that is fixed to the depressed portion 5 of the frame 3 by means of screws 81 (FIG. 4). The fixed platform 80 has opposite vertical walls 90, 100. Two cylindrical sliding guides 150 for a transverse slide 160, moving forward parallel to the axis x of the shaping pulley 1, are connected to the opposite vertical walls 90, 100 by screws 140. Under the fixed platform 80, an operation device of known lever type, that is indicated in general as 190, is located that constitutes the manual control member of movement of the transverse slide 160 on the cylindrical guides 150.

A movable platform 181 is connected to the transverse slide 160. On the movable platform 181 there are cylindrical sliding guides 151 for a lengthwise slide 161, having an approaching stroke and a moving away stroke with respect to a shaping pulley 1 along a lengthwise direction N of movement of the grinding belt 2. A workpiece vice 20 is mounted revolving on the lengthwise slide 161. As in the first embodiment, the workpiece vice 20 has a base 21, which is provided with a slot 22 in the form of a circle arch and a securing screw 23 to the lengthwise slide 161, for setting the angular position of the workpiece vice 20 with respect to the direction N of movement of the grinding belt 2.

Further, the lengthwise slide 161 is constrained to a straight linear cam 30 that can swing in its angle, coplanar to the parallel sliding planes of the transverse and lengthwise slides 160, 161.

The swinging straight linear cam 30 is formed by a channel 31 that is pivoted at right angles on the fixed platform 80 of the worktable 60 by means of a rotation pin 32 (FIG. 4). As shown in FIG. 5, the channel 31 has off-centre a setting pin 33 that is received into a circle arch-shaped slot 34 of the fixed platform 80 to be locked in the desired position by a locking lever 39.

As shown in FIG. 4, the cam follower of the linear cam 30 is a sliding roller 35 in the channel 31. The sliding roller 35 is connected to the lengthwise slide 161 by means of a screw 36 and an arm 37. The arm 37 is preferably lightened by a through slot 38, in order to permit the roller 35 to be fixed in such a way that the linear cam 30 can be set without any obstacle throughout the slot 34.

The operation of the second embodiment of worktable is similar to that of the first embodiment described with reference to FIGS. 1 to 3.

In this second embodiment, the angle $\alpha$ is the angle between the sliding axis y in the linear cam 30 and the axis x of the shaping pulley 1. The angle $\alpha$ is selected analogously to the first embodiment.

In grinding a recess in a tubolar workpiece, once the linear cam 30 has been adjusted according to the desired angle relevant to the diameter to be worked, it is enough to operate the sole lever control member 190, to displace the transverse slide 160 throughout the width of the grinding belt 2. In the same time, the lengthwise slide 161, by virtue of the linear cam 30, will move forward against the shaping pulley 1 to perform the desired grinding.

Figure 8:
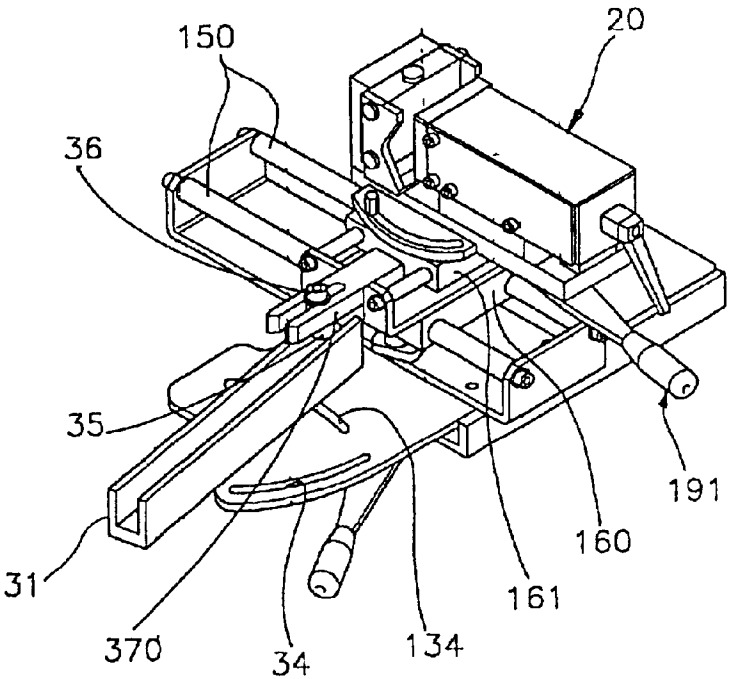
FIG. 8 is a perspective view of a modified second embodiment of a worktable.
Figure 9:
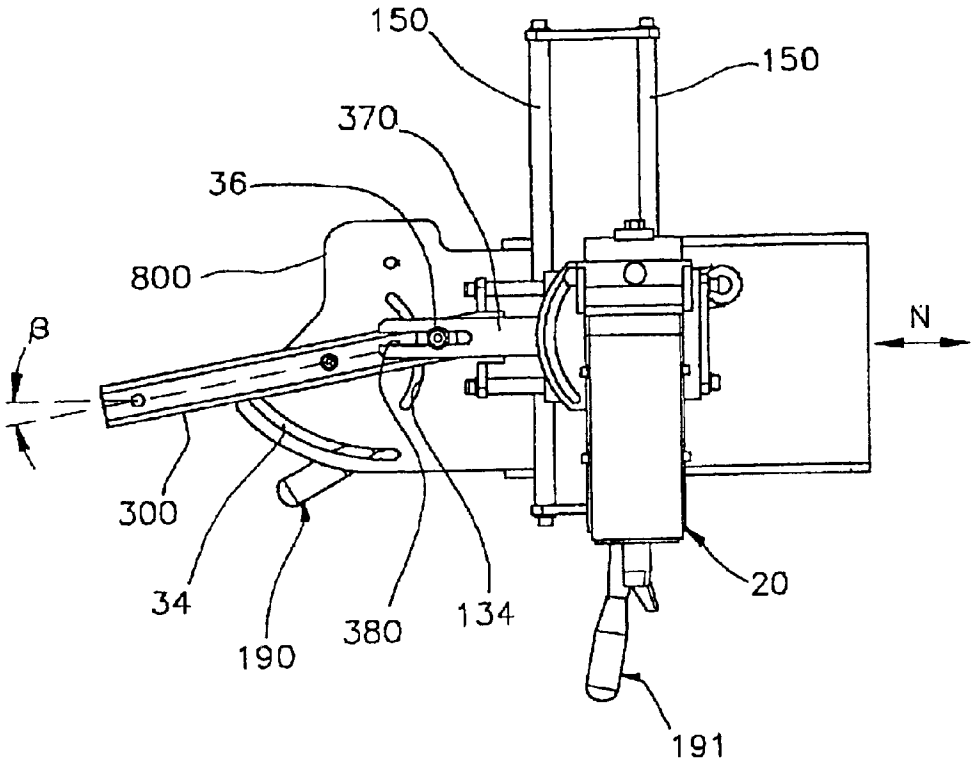
FIG. 9 is a top view of the worktable in FIG. 8.
Figure 10:
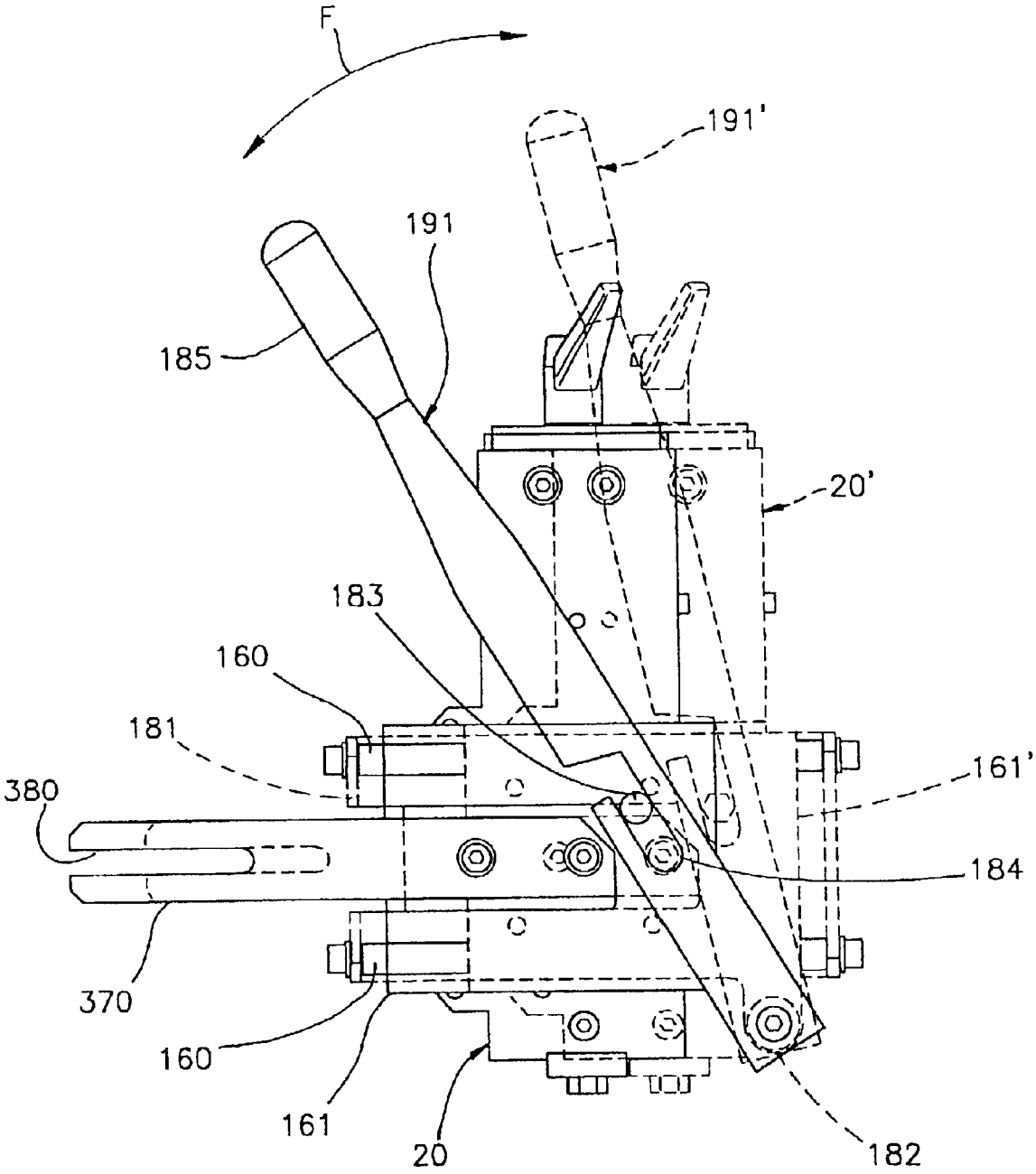
FIG. 10 is a fragmentary bottom view of the longitudinal slide of the worktable in FIG. 8.

With reference to FIGS. 8 to 10, there is shown a modified second embodiment of the worktable according to the present invention. This modified embodiment is particularly developed to work workpieces of large diameter, in which the amount of lengthwise feeding of the workpiece vice is great, since this amount can reach the measure of the radius of the same workpieces.

In FIGS. 8 to 10 same or similar numeral references are used to designate same parts or similar to those in FIGS. 4 to 7.

As a result of the great lengthwise feeding of the worktable, a swinging straight linear cam 300 must be set on a platform 800 so that an angle β of inclination between the axis of this linear cam 300 and the direction of lengthwise feeding. For this purpose a second circle arch-shaped slot designed as 134 is used. This slot 134 works like the slot 34 of the fixed platform 80 and then is described no longer.

In this modified second embodiment, the lever operation device to manually control the forward movement of the transverse slide 160 on the cylindrical guides 150, that is located under the platform 80, either is not comfortably usable or cannot be used because of great counteracting forces produced by the sliding on the cam that is substantially orthogonal to the operation of the transverse slide.

For this reason it is suitable to perform the control for feeding the workpiece vice directly on its slide provided with lengthwise traverse, i.e. by acting substantially directly in the same direction of the sliding roller 35 in the channel 31 of the linear cam 30. The sliding roller 35 is connected to the lengthwise slide 161 by means of a screw 36 and an arm 370. The arm 370 is preferably provided with an open slot 380 so that the roller 35 is fixed easier.

In this modified second embodiment it is the lengthwise slide 161 to be directly operated by an auxiliary lever 191 as shown in FIG. 10, that is a bottom view taken from the movable platform 181 of the lengthwise slide 161. The auxiliary lever 191 is pivoted removably near a front corner 182 of the movable platform 181 opposite to the operation side of the lengthwise slide 161. Suitably, the lengthwise slide 161 is provided at the bottom with a pin 183 designed to engage an open shaped slot 184 that is made intermediately in the auxiliary lever 191.

In operation, once the lever 190 has been disconnected, when the auxiliary lever 191 is operated through its handle 185 according to a double-pointed arrow F until it is moved to its position 191' (shown by a dotted line), the lengthwise slide 161 is moved forward to 161' being displaced also transversally on the transverse slide 160 by virtue of the engagement with the linear cam 300, and the vice 20 is brought to 20'.

The invention can be modified without departing from its scope. For example, in the described embodiments, the operation control has been described as a handwheel or a lever. Of course, these manual controls can be servocontrolled or powered as conventionally, for example through a pneumatic circuit.

What is claimed is:

1. A worktable for an apparatus for grinding recesses comprising:

a frame (3) having a pair of pulleys carrying a grinding belt (2) moving endlessly along a lengthwise axis of said frame (3);

the worktable supporting a workpiece vice (20) that is pivoted around an orthogonal pivoting axis on a first slide (16; 161) so as to be set in its angular position with respect to a shaping pulley (1) of said pair of pulleys; and a sole control member (19; 190; 191) to move said workpiece vice (20) both transversely with respect to said shaping pulley (1) and to and away from said shaping pulley.

2. The worktable according to claim 1, wherein said sole control member (19; 190; 191) is manually operated.

3. The worktable according to claim 1, wherein said sole control member is powered.

4. A worktable for an apparatus for grinding recesses comprising:

a frame (3) having a pair of pulleys carrying a grinding belt (2) moving endlessly along a lengthwise axis of said frame (3);

the worktable (6; 60) supporting a workpiece vice (20) that is pivoted around an orthogonal pivoting axis on a first slide (16; 161) so as to be set in its angular position with respect to a shaping pulley (1) of said pair of pulleys; and a sole control member (19; 190; 191) to approach and move apart said workpiece vice (20) with respect to said shaping pulley (1), wherein said first slide (16) is mounted slidingly on a revolving platform (8) that is pivoted on said frame (3) around an axis parallel to said pivoting axis of the workpiece vice (20), said revolving platform (8) being adjustable in position with respect said frame (3), and wherein said sole control member comprise a handwheel (19) for moving said first slide (16).

5. A worktable for an apparatus for grinding recesses comprising:

a frame (3) having a pair of pulleys carrying a grinding belt (2) moving endlessly along a lengthwise axis of said frame (3);

the worktable (6; 60) supporting a workpiece vice (20) that is pivoted around an orthogonal pivoting axis on a first slide (16; 161) so as to be set in its angular position with respect to a shaping pulley (1) of said pair of pulleys; and a sole control member (19; 190; 191) to approach and move apart said workpiece vice (20) with respect to said shaping pulley (1), wherein said first slide (161), sliding along a sliding direction parallel to the lengthwise axis of the frame (3), is fixed by a first movable platform (181) on a second slide (160) sliding on a second fixed platform (80; 800) along a sliding direction orthogonal to said lengthwise axis of the frame (3), said sliding directions lying on mutually parallel planes, said first slide (161) being further connected to a straight linear cam (30; 300) swinging in its angle coplanar to said parallel planes on said fixed platform (80; 800), and wherein said sole control member comprises a lever (190; 191) for moving said second slide.

6. The worktable according to claim 5, wherein said swinging straight linear cam (30; 300) comprises a channel (31) pivoted at right angles on said fixed platform (80) and has off-center a setting pin (33) that is received into a circle arch-shaped slot (34; 134) of the fixed platform (80; 180) to be locked therein in the desired position, and the cam follower of said linear cam (30; 300) is a sliding roller (35) in said channel (31), the sliding roller (35) being connected to said first movable slide (161) by means of an arm (37; 370).

* * * * *